United States Patent [19]

Gribbins

[11] Patent Number: 4,984,410

[45] Date of Patent: Jan. 15, 1991

[54] APPARATUS OF WINDING AND PACKAGING SHOELACES INTO PAIRS

[75] Inventor: William R. Gribbins, Lincolnton, N.C.

[73] Assignee: General Shoelace Co., Louisville, Ky.

[21] Appl. No.: 383,718

[22] Filed: Jul. 24, 1989

[51] Int. Cl.[5] ..... B56B 27/06; B56B 63/04

[52] U.S. Cl. ..... 53/116; 53/586

[58] Field of Search ..... 53/116, 118, 530, 586; 242/39, 47, 53

[56] References Cited

U.S. PATENT DOCUMENTS

| | | | |
|---|---|---|---|
| 3,024,580 | 3/1962 | McIntyre | 53/430 |
| 3,416,287 | 12/1968 | Hawkins et al. | 53/399 |
| 3,473,747 | 10/1969 | Takai et al. | 242/53 |
| 3,906,701 | 9/1975 | McIntyre | 53/399 |
| 4,052,019 | 10/1977 | Dickson, Jr. | 242/39 X |
| 4,066,217 | 1/1978 | Smith et al. | 242/47 X |
| 4,194,340 | 3/1980 | McIntyre | 53/586 X |
| 4,315,607 | 2/1982 | Felix | 242/39 X |

*Primary Examiner*—Robert L. Spruill

*Assistant Examiner*—Linda B. Johnson

*Attorney, Agent, or Firm*—Jon C. Winger

[57] ABSTRACT

An apparatus for winding and packaging shoelaces into pairs with a circumscribing label therearound to hold the shoelace pair together in an oblong configured package. The apparatus includes a winding station for winding a pair of shoelaces into a circular coil configuration, a flattening station for flattening the circular shoelace coil into an oblong configuration, a device to transfer the circular configured shoelace pair from the winding station to the flattening station, a label delivery station proximate the flattening station for delivering labels to be wound around the oblong configured shoelace pair across the flattening station, a label wrapping station adjacent the flattening station in alignment with the label for wrapping the label about the oblong configured shoelace pair, and a device for moving the oblong configured shoelace pair and label from the flattening station to the wrapping station. The operation of the various stations of the apparatus are controlled by a central control device.

12 Claims, 5 Drawing Sheets

APPARATUS OF WINDING AND PACKAGING SHOELACES INTO PAIRS

BACKGROUND OF THE INVENTION

The present invention relates to an apparatus for forming coils of flexible strands of material, and more particularly for winding and packaging shoelaces into flattened coils of shoelace pairs.

Various apparatus for winding flexible strands of material are known. Examples of such known apparatus as shown in the following U.S. Patents. U.S. Pat. No. 677,993 issued on July 9, 1901 to W. Jones; U.S. Pat. No. 697,006 issued on Apr. 8, 1902 to C. Nuhring; U.S. Pat. No. 972,222 issued on Oct. 11, 1910 to W. L. Paul; and U.S. Pat. No. 1,202,645 issued on Oct. 24, 1916 to J. L. Baldwin each show a hose reel. U.S. Pat. No. 2,620,609 issued on Dec. 9, 1952 to D. H. Pope; U.S. Pat. No. 3,053,024 issued on Sept. 11, 1962 to J. Wexler; and U.S. Patent No. 3,145,516 issued on Aug. 25, 1964 to C. N. Hannon et al each show an apparatus for packaging newspapers. U.S. Pat. No. 3,694,998 issued on Oct. 3, 1972 to M. D. Brinkley shows an apparatus for wrapping a flexible endless band, such as a tube for a pneumatic tire into a coil. More particularly, U.S. Pat. No. 3,024,580 issued on Mar. 13, 1962 to N. McIntyre; U.S. Pat. No. 3,416,287 issued on Dec. 17, 1968 to J. L. Hawkins et al; and U.S. Pat. No. 3,906,701 issued on Sept. 23, 1975 to N. McIntyre each show an apparatus for packaging shoelaces by first forming a circular coil of the shoelaces, flattening the shoelace coil, and applying a label around the flattened shoelace coil.

An object of the present invention is to provide an apparatus for winding and packaging shoelaces in pairs which provides a much less complicated apparatus than the prior-art apparatus discussed above.

It is another objective of the present invention to provide an apparatus for winding and packaging shoelaces in pairs which includes a novel counting device for controlling the winding station of the apparatus.

It is yet another objective of the present invention to provide an apparatus for winding and packaging shoelaces in pairs which employs air-operated actuator devices to operate the major workstations thereof.

It is still another objective of the invention to provide an apparatus for winding and packaging shoelaces in pairs of the class described which further includes a central control device for controlling the operation of the various air-operated actuator devices in proper sequence.

SUMMARY OF THE INVENTION

More particularly, the present invention provides an apparatus for winding and packaging shoelaces in pairs includes a winding station at which the pairs of shoelaces are wound into circular coils, a conveyor to deliver pairs of shoelaces to be packaged to a delivery position adjacent the winding station, an air-actuated device for transporting the pairs of shoelaces to be wound from the conveyor at the delivery position of the winding station, a counter for counting the number of revolutions of the winding station as a pair of shoelaces are wound thereon, an air-actuated device operatively associated with the counter for disengaging the winding station ejecting the wound shoelace pair therefrom at a preselected number of revolutions, a coiled shoelace pair flattening station adjacent the winding station for flattening the shoelace coil, an air-actuated device for removing the coiled shoelace pair from the winding station and moving the shoelace pair into the flattening station, a label delivery station at the flattening station for positioning a label adjacent the flattened shoelace coil operated in response to the air-actuated device which moves the shoelace coil into the flattening station, a wrapping station located adjacent the flattening station in alignment with the flattened coil and label for wrapping the label around the flattened shoelace coil, an air-actuated device for ejecting the flattened shoelace coil from the flattening station to the wrapper station and concurrently delivering the label with the flattened shoelace coil to the wrapper station, and a central control device for controlling the operation of all of the various air-operated devices in properly tuned relationship.

BRIEF DESCRIPTION OF THE DRAWINGS

A better understanding of the present invention will be had upon reference to the following specification in conjunction with the accompanying drawings, wherein like numerals refer to like parts throughout the several views and in which.

DETAILED DESCRIPTION OF THE PREFERRED EMBODIMENT

Figure 1:
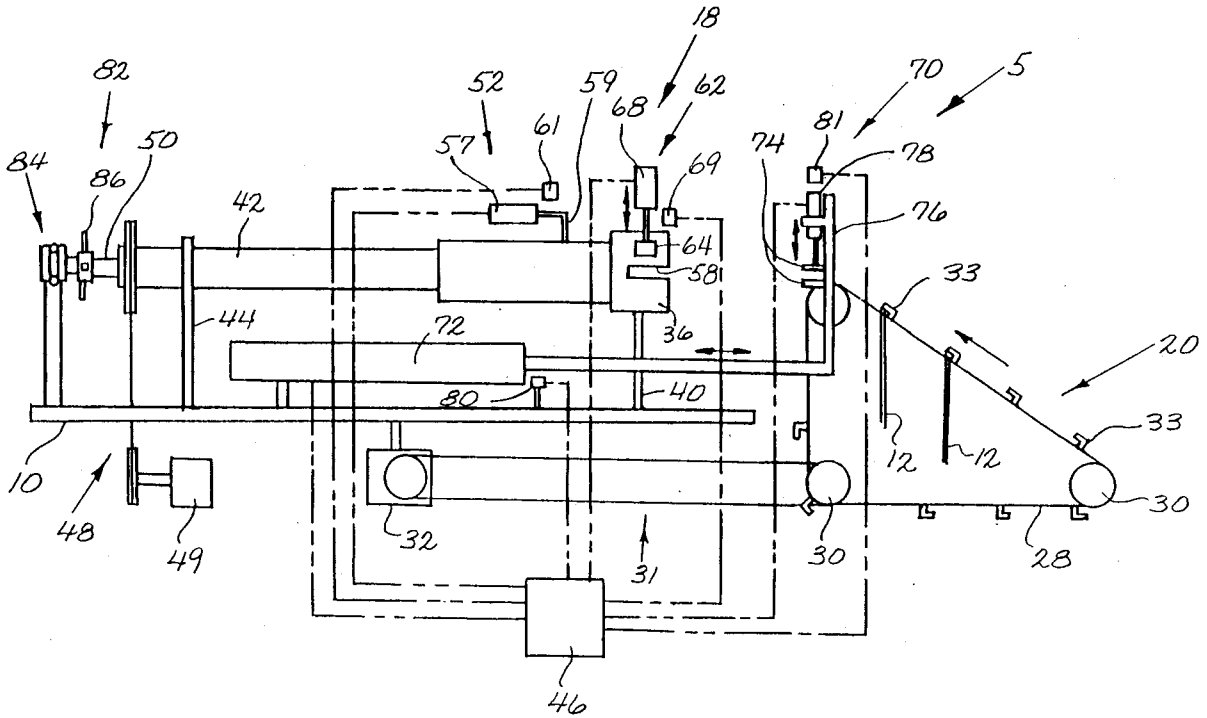
FIG. 1 is a schematic representation of one side of an apparatus for winding and packaging shoelaces into pairs of the present invention.

With reference to FIGS. 1–6, there is shown an apparatus of the present invention generally denoted as the numeral 10, for winding and packaging shoelaces 12 into flattened coiled packages 14 circumscribed by a label 16.

The apparatus 5 has a frame structure 10 which supports the various components of the apparatus 5. The apparatus 5 comprises a shoelace pair winding station 18, a conveyor 20 for delivering pairs of shoelaces 12 to be wound to the winding station 18, a coiled shoelace pair flattening station 22 next to the winding station 18 for receiving pairs of wound shoelace pairs therefrom and flattening the shoelace pair coil into an oblong coil, a label delivery station 24 at the flattening station 22 for positioning a label 16 across a flattened shoelace pair coil in the flattening station 22, and a label wrapping station 26 located next to the flattening station 22 in alignment with the flattened shoelace pair coil in the flattening station 22 and the positioned label 16 for receiving the flattened shoelace pair coil from the flattening station 22 and label 16 disposed thereacross for wrapping the label 16 circumferentially around the flattened shoelace pair coil to form the finished shoelace pair package 14. A central control means 46, such as a computer or processor controls the operation of the various stations in properly timed relationship.

Figure 2:
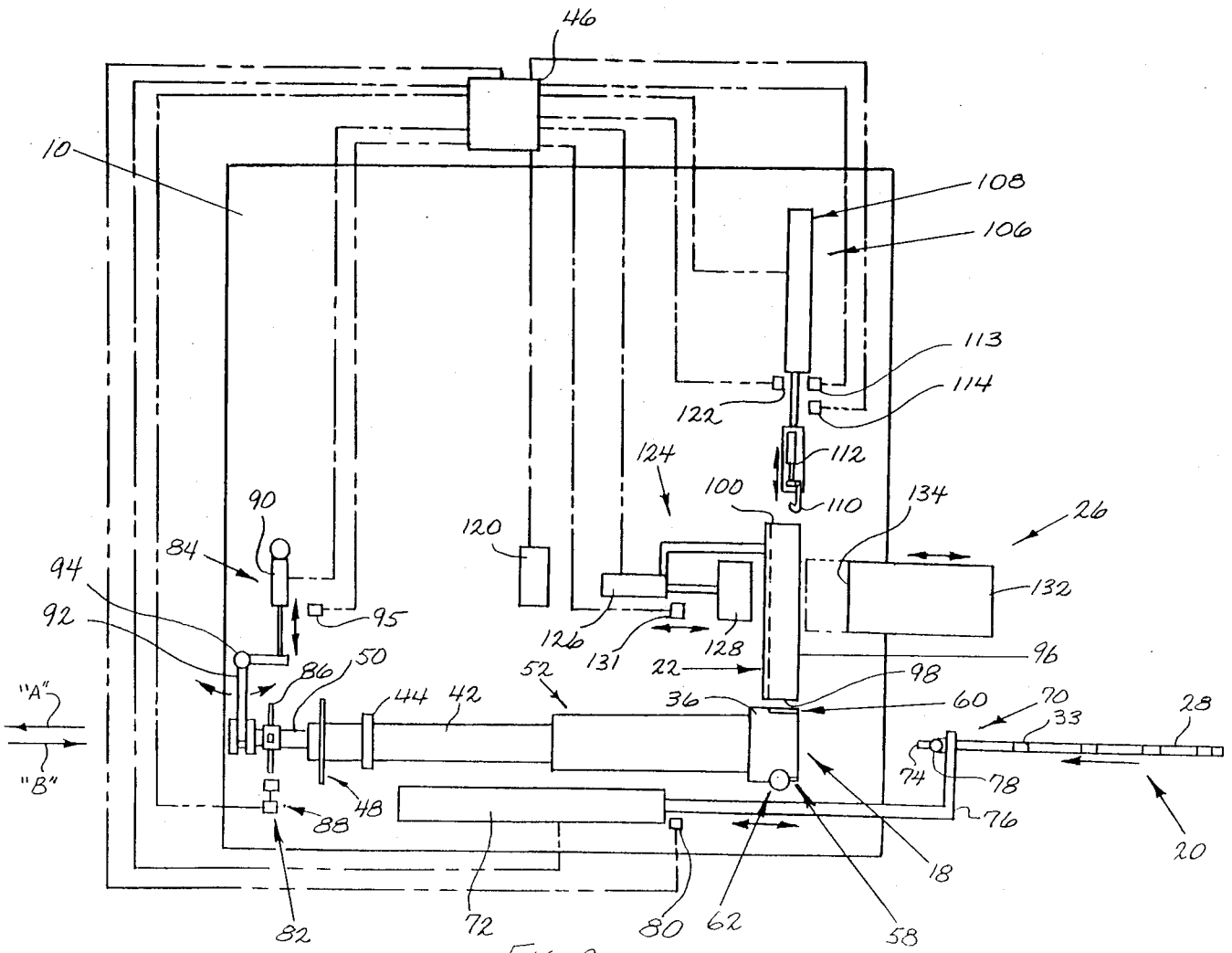
FIG. 2 is a schematic representation of a top view of the apparatus of FIG. 1.

With reference to FIGS. 1 and 2, the conveyor device 20 is shown as an endless chain-type conveyor having an endless chain 28 trained about sprockets 30. As shown, the conveyor device 20 is driven through a chain drive 31 from, for example, an air actuator 32 or electric motor, located beneath the top of the frame structure 10. A plurality of shoelace carrying hooks 33 are attached to the chain 28 at equally spaced apart intervals therealong. The hooks 33 are configured to frictionally engage one end of a pair of side-by-side shoelaces 12 to be wound into a coil. The conveyor device 20 delivers pairs of shoelaces one at a time to a delivery position adjacent the shoelace pair winding station 18.

Figure 3:
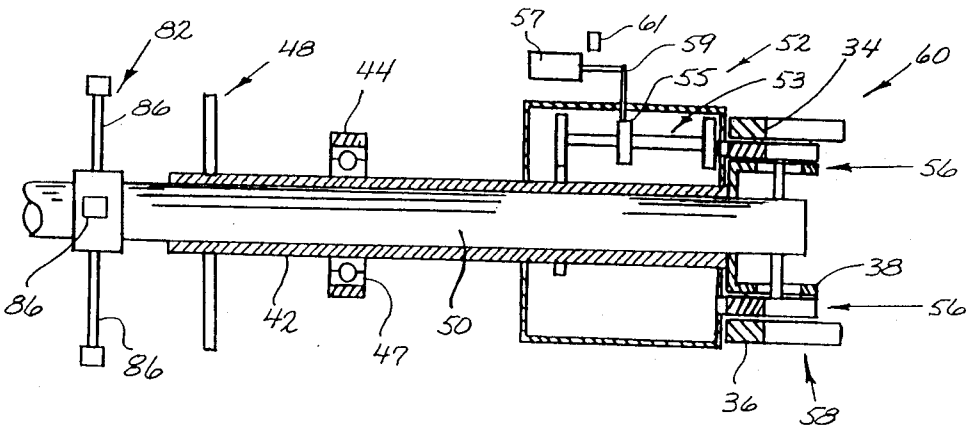
FIG. 3 is an enlarged schematic representation top view, in cross-section, of a portion of the apparatus of FIG. 1.

With continued reference to FIGS. 1 and 2, and additional reference to FIG. 3, the winding station 18 includes a rotatable cylindrical mandrel 34 about which the shoelace pairs are wound into a shoelace pair coil, a non-rotating fixed position cylindrical shoelace coil confining sleeve 36 concentrically receiving the cylindrical mandrel 34, and a fixed position rotating doffing sleeve 38 concentrically received within the cylindrical mandrel 34. The shoelace confining sleeve 36 is mounted in a fixed position to the frame structure 10 by, for example, a bracket 40. The doffing sleeve is mounted for rotation about its longitudinal axis by a drive tube 42 which is, in turn, mounted in a support bracket 44 attached to the frame structure 10 by bearings 47. The drive tube 42 is driven for rotation about it longitudinal axis by, for example, a chain drive 48 driven by an electric motor 49. The cylindrical mandrel 34 is mounted for rotation about its longitudinal axis for winding the shoelace pairs about its periphery and for movement relative to the shoelace confining sleeve 36 and doffing sleeve 38 by means of a mandrel shifting shaft 50. The mandrel 34 is attached to one end of the mandrel shifting shaft 50, and the mandrel shifting shaft 50 is concentrically disposed within the doffing sleeve drive tube 42 for longitudinal movement within the drive tube 42 and for selective rotation with the doffing sleeve 38 about the coaxis of the drive tube 42 and mandrel shifting shaft 50. The selective rotation of the shifting shaft 50 with the doffing drive tube 42 can be accomplished by using transmission means 52. The transmission means 52 is in driven operation relationship with the doffing drive tube 42 and in selective driving operation relationship with the shifting shaft 50 through a gear train generally denoted as the numeral 53, and a clutch device 55. Thusly, when the transmission clutch 55 is engaged, the rotating doffing drive tube 42, which is driven by the electric motor 49 through the chain drive 48, drives the shifting tube 50 for rotation therewith through the gear train 53 of the transmission means 52 so that the mandrel 34 and doffing sleeve 38 are rotated together. And, when the transmission clutch 55 is disengaged, the doffing drive tube 42 continues to rotate, but the shifting shaft 50 is not caused to rotate because the clutch device 55 has disengaged the gear train 53 so that the mandrel 34 is stationary while the doffing sleeve continues to rotate. The transmission means 52 is operated to selectively engage the doffing drive tube 42 to the shifting shaft 50 and disengage the doffing drive tube 42 from the shifting shaft 50 by means of a first solenoid operated air-operated device 57 operatively associated with the central control unit 46, such as a pneumatic cylinder device, for selectively engaging and disengaging the transmission clutch 55. For example, with reference to the schematic of FIG. 3, the operating rod of the first pneumatic cylinder device 53 can be operatively connected with the transmission clutch by means of a lever 59 operatively interconnecting to the clutch 55 to the operating rod of the first pneumatic cylinder device 57 so that, for example, when the first pneumatic cylinder device 57 is operated to extend its operating rod, it disengages the clutch device 55, and when the first pneumatic cylinder device 57 is operated to retract its operating rod, it engages the clutch device 55. Sensor means 61, such as a proximity switch, is located at the first air-operated device 57 and operatively associated with the central control means 46 to signal the central control means 46 that the clutch device 55 has been disengaged and the shifting shaft 50 and, therefore, winding mandrel 34, has stopped rotating. Further, as the mandrel shifting shaft 50 is moved longitudinally in one direction, the mandrel 34 is moved axially out of the confining sleeve 36 and as it is moved longitudinally in the other direction, the mandrel 34 is moved axially back into the confining sleeve 36.

Figure 4:
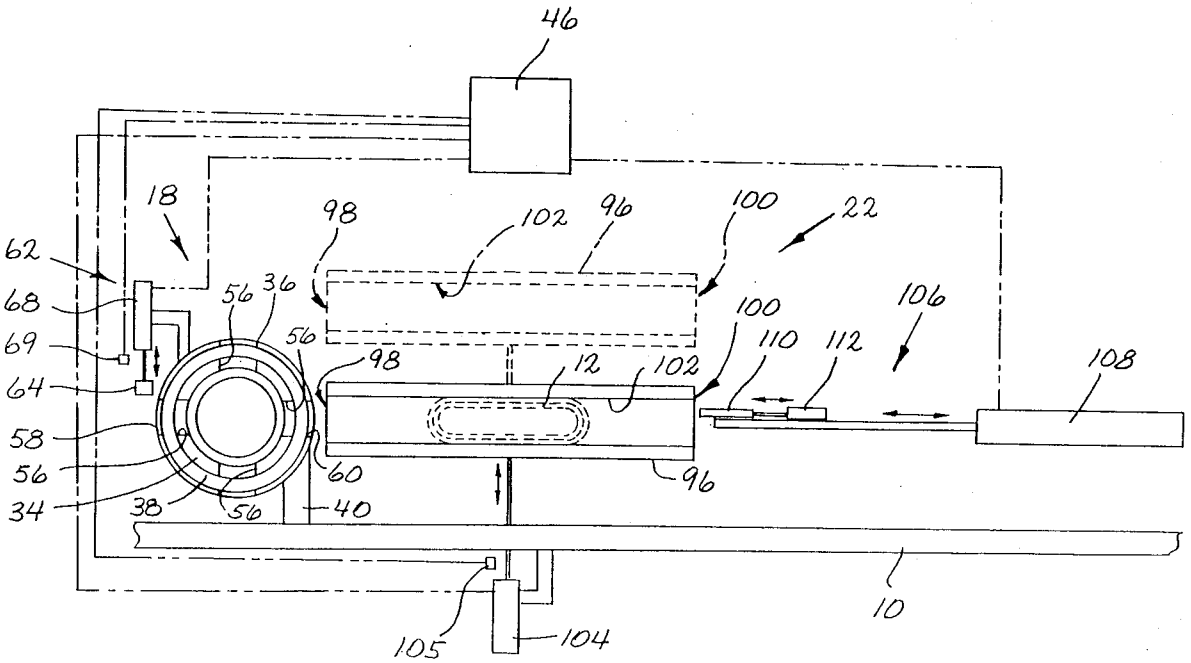
FIG. 4 is an enlarged schematic front view of a portion of the apparatus of FIG. 1.
Figure 6:
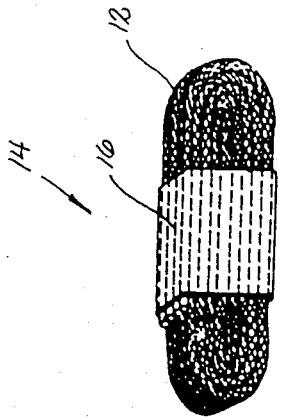
FIG. 6 is a view of a shoelace pair package made by the apparatus of the present invention.

With reference to FIGS. 1 and 4, the shoelace winding mandrel 34 is formed with circumferentially spaced apart receiving slots 56 open to the front end of the mandrel 34. The shoelace confining sleeve 36 is formed with a shoelace entrance shot 58 open to the front end of the sleeve 36 and a diametrically opposed shoelace exit slot 60 open to the front end of the sleeve 36.

With reference to FIGS. 2 and 4, the shoelace winding station 18 also includes a shoelace tensioning device 62 located at the exterior of the confining sleeve 36 adjacent the shoelace entrance slot 58 for exerting a tension on and guiding a shoelace extending through the entrance slot 58 as it is being wound on the mandrel 34. The shoelace tensioning device 62 includes a foot 64 which is moved toward the confining sleeve 36 at the entrance slot 58 to engage a shoelace extending through the entrance slot 58 and away from the confining sleeve 36 to clear the entrance slot 58 for the insertion in the entrance slot 58 of the next shoelace pair to be wound on the mandrel 34. The shoelace tensioning device 62 also includes a solenoid-operated second first air-operated device 68, such as a pneumatic cylinder device operatively associated with the central control unit 46 for selectively moving the foot 64 toward and away from the confining sleeve 36. The foot 64 can be attached to the distal end of the operating rod of the pneumatic cylinder device 68. Sensor means 69, such as a proximity switch, is located at the second air-operated device 68 to signal the central control means 46 that the shoelace tensioning device has moved away from the confining sleeve 36.

With reference to FIGS. 1 and 2, the shoelace pair winding station 18 also includes a shoelace gripping and transfer device 70 for transferring shoelace pairs to be wound from the shoelace carrying hook 33 of the conveyor device 20 at the delivery position to the mandrel 34 and confining sleeve 36 of the winding station 18. As shown, the gripping and transfer device 70 includes a solenoid-operated third air-operated device 72 operatively associated with the central control unit 46, such as a pneumatic cylinder device, attached to the frame structure 10 with its operating rod parallel to the longitudinal axis of the drive tube 42 for extension toward the delivery position of the conveyor device 20 and retraction away from the conveyor device toward the mandrel 34 and confining sleeve 36. A pair of shoelace gripping jaws 74 are attached to a suitable bracket 76 mounted at the distal end of the operating rod of the third pneumatic cylinder device 72. At least one of the jaws of the jaw pair 74 is movable toward and away from the other one of the jaws of the jaw pair 74. The jaws 74 are closed on the shoelace pair in the hook 33 of the conveyor device at the delivery position so that as the operating rod of the cylinder device 72 retracts the shoelace pair are removed from hook 33 and delivered to the entrance slot 58 of the confining sleeve 36 and shoelace receiving slot 56 of the mandrel 34. Upon delivery of the shoelace pair to be wound to the mandrel 34 and confining sleeve 36, the jaws 74 are opened to release the shoelace pair at the winding station 18 and in preparation for closing on another shoelace pair in the next succeeding hook 33 of the conveyor device at the delivery position as the operating rod of the third cylinder device 72 extends back toward the delivery position of the conveyor device 20. As shown best in FIG. 1, the movable one of the jaws of the jaw pair 74 is selectively moved toward and away from the other one of the jaws of the jaw pair by a solenoid-operated fourth air-operated device 78 operatively associated with the central control unit 46, such as a pneumatic cylinder device attached to the bracket 76 with the distal end of its operating rod attached to the movable jaw of the jaw pair 74. Sensor means 80, such as a proximity switch, is located at the third pneumatic cylinder device 72 and operatively associated with the central control means 46 to signal the central control means 46 third cylinder device 72 has positioned the jaws 74 at the mandrel 34 and when the third cylinder device 72 has repositioned the jaws 74 at the delivery position. Sensor means 81, such as a proximity switch, is located at the fourth cylinder device 78 and operatively associated with central control means 46 to signal the central control unit 46 when the jaws 74 have moved apart to release a shoelace pair and when the jaws 74 have closed to grasp another shoelace pair. As the gripping and transfer device 70 deposits a shoelace pair to be wound in the slot 56 of the mandrel 34 and entrance slot 58 of the confining sleeve 36, the second pneumatic cylinder device 68 of the tensioning device 62 is actuated to cause the foot 64 thereof to engage the shoelace pair in the slot 56 of the mandrel 34 and entrance slot 58 of the confining sleeve 36.

Now with reference to FIGS. 1, 2, and 3, the shoelace pair winding station 18 further includes mandrel revolution determining means, generally denoted as the numeral 82, for determining the number of revolutions made by the mandrel 34 when it is in the forward position inside the sleeve 36 as it winds a shoelace pair thereon. The revolution determining means is operatively associated with a counter of the control means 46 in which is stored the predetermined number of revolutions of the mandrel 34 corresponding to the length of the shoelace pair to be wound on the mandrel. The revolution determining means 82 includes a plurality of radial projections 86 attached to the mandrel shifting shaft 50 for rotation therewith and movement therewith longitudinally of the drive tube 42. The radial projections are spaced apart from each other about the circumference of the mandrel shifting shaft 50. The revolution determining means 82 also includes sensor means 88 operatively associated with the central control unit 46 is located adjacent the imaginary circle circumscribed by the distal ends of the radial projections 86 when the shifting shaft 50 is in the forward position locating the mandrel 34 inside the confining sleeve 36 for sensing the movement therepast of each projection 86. The sensor means 88 can be, for example, a proximity switch, such as a photocell device, a magnetic flux generator, and the like. As best seen in FIG. 2, shifting means 84 moves the mandrel shifting shaft 50 to move the mandrel 34 into and out of the confining sleeve 36 and includes a solenoid-operated fifth air-operated device 90 operatively associated with the central control unit 46, such as a pneumatic cylinder device attached to the frame structure 10. The shifting means 84 moves the mandrel shifting shaft 50 axially of the drive tube 50 to move the mandrel 34 out of the confining sleeve 36 and, thereby, withdrawing from the coiled shoelace pair leaving the coiled shoelace pair in the confining sleeve 36, and moves the mandrel 34 back into the confining sleeve 36 in preparation for winding another shoelace pair on the mandrel 34. The shifting means 84 operatively interconnects the shifting shaft 50 to the central control means 46 by, for example, a linkage 92 which is connected at one end to the end of the shifting shaft 50 extending from the drive tube 42 proximate the projections 86 and is operatively connected at its other end to the distal end of the operating rod of the fifth pneumatic cylinder device 90. The linkage 92 is pivotably mounted at 94 between its ends to the frame structure 10 for pivotable movement back and forth about the pivot 94. Sensor mean 95 at the fifth air-operated device 90 is operatively associated with the central control means 46 to signal the central control unit 46 when the shifting shaft 50 has been moved withdrawing the mandrel 34 out of the confining sleeve 36.

When the counter of the central control unit 46 has counted a number of signals received thereby from the sensor means 88 corresponding to the predetermined number of revolutions of the mandrel shifting shaft 50 and, therefore, the mandrel 34, the fifth pneumatic device 90 of the shifting means 84 is actuated by the control unit 46 to move the mandrel shifting shaft 50 longitudinally in a direction out of the drive tube 42 thereby removing the mandrel 34 from the confining sleeve 36. In the embodiment of FIGS. 1, 2 and 3, this is accomplished by operating the fifth pneumatic cylinder device 90 to extend its operating rod which pushes the linkage 92 in a clockwise direction as seen in FIG. 2 about pivot 94 thereby pulling the mandrel shifting shaft 50 in a longitudinal direction out of the drive tube 42 as indicated by the arrow "A" in FIG. 3. When the fifth pneumatic cylinder device 90 is operated to retract its operating rod, it pulls the linkage 92 in a counter-clockwise direction as seen in FIG. 2 about the pivot 94, thereby pushing the mandrel shifting shaft 50 in the other longitudinal direction back into the drive tube 42 as indicated by the arrow "B" to position the mandrel 34 back into the confining sleeve 36 in preparation for winding the next succeeding shoelace pair to be delivered to the winding station 18 by the shoelace gripping and transfer device 70.

Figure 5:
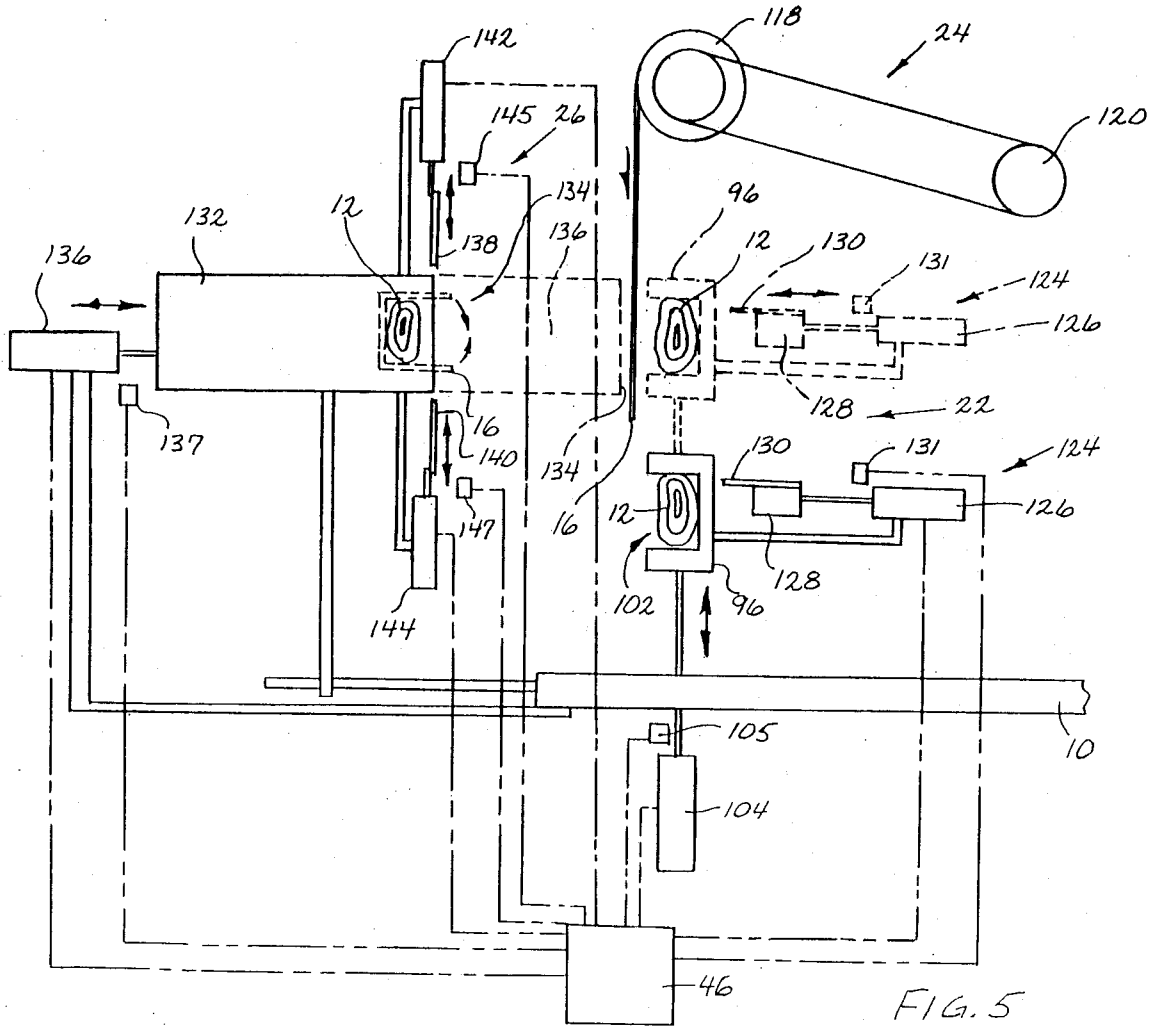
FIG. 5 is an enlarged schematic cross-sectional view of the apparatus of FIG. 1 as seen in the direction of arrows 5—5 in FIG. 2.

Now with reference to FIGS. 2, 4 and 5, the coiled shoelace pair flattening station 22 comprises an elongated shoelace receiving channel member 96 having an open shoelace coil entrance end 98 and an open opposite end 100. The channel 96 is mounted horizontally on the frame structure 10 for movement in a vertical direction transverse to its longitudinal axis between a lowered position (solid lines in FIGS. 4 and 5) whereat the open entrance end 98 is adjacent to and in alignment with the shoelace coil exit slot 60 of the confining sleeve 36, and a raised position parallel to and spaced above the lowered position (broken lines in FIGS. 4 and 5). The channel 102 defined by of the channel member 96 is open to the front longitudinal side of the channel member 96 and is as wide between its longitudinal top and bottom walls of the channel member 96 as the width of the paired shoelace oblong coil to be formed. The channel member 96 is movable between its raised and lowered positions by a solenoid-operated sixth air-operated device 104 operatively associated with the central control unit 46, such as a pneumatic cylinder device. The sixth pneumatic cylinder device 104 is vertically disposed and mounted to the frame structure 10 and the channel member 98 is attached to the distal end of the operating rod of the sixth pneumatic cylinder device. Thus, as the sixth pneumatic cylinder device 104 is operated to extend its operating rod, the channel member 96 is raised and as the sixth pneumatic cylinder is device 104 is operated to retract its operating rod, the channel member 96 is lowered. Sensor means 105, such as a proximity switch, at the sixth pneumatic cylinder device 104 is operately associated with the central control unit 46 to signal the central control unit 46 of the position of the channel member 98.

As can be best seen in FIGS. 2 and 4, a device 106 for removing the coiled shoelace pair from the winding station and moving the coiled shoelace pair into the channel 102 of the flattening station 22 is located proximate the open opposite end 100 of the channel member 96. The device 106 for removing the shoelace coil and moving the shoelace coil into the receiving channel is shown as a solenoid-operated seventh air-operated device 108 operatively associated with the central control unit 46, such as a pneumatic cylinder device, positioned at the open end 100 of the channel member 102 with its operating rod in longitudinal alignment with the longitudinal axis of the channel 102 when the channel member 96 is in its lowered position. The seventh pneumatic cylinder device 108 is operated so that its operating rod extends longitudinally into the channel 102 and retracts back out of the channel 102. A fixture is attached to the distal end of the operating rod of the seventh pneumatic cylinder device 108 and includes a pivotally mounted shoelace coil engaging hook 110. The hook 110 is caused to selectively pivot toward a shoelace coil to engage the coil at the winding station 18 and away from the shoelace coil to disengage the flattened shoelace coil in the channel member 96 by a solenoid-operated eighth air-operated device 112 operatively associated with the central control unit 46, such as a pneumatic cylinder device, mounted on the fixture at the distal end of the operating rod of the seventh pneumatic cylinder device 108. The distal end of the eighth pneumatic cylinder device 112 is connected to the hook 110 to pivot the hook 110 toward the shoelace coil when the eighth pneumatic cylinder device 112 is operated to extend its operating rod and to pivot the hook 110 away from the shoelace coil when the eighth pneumatic cylinder device 112 is operated to retract its operating rod. After a shoelace pair has been wound on the mandrel 34 and the mandrel 34 has been withdrawn from the confining sleeve 36 leaving the shoelace coil in the confining sleeve 36, the seventh pneumatic cylinder device is operated to extend its operating rod longitudinally through the channel 102 of the lowered channel member 96 to position the shoelace coil engaging hook 110 at the distal end of its operating rod adjacent the confining sleeve 36 of the winding station 18. The eighth pneumatic cylinder device 112 is then operated to extend its operating rod causing the hook 110 to pivot toward the shoelace coil in the cylindrical sleeve 36 and engage the shoelace coil. The seventh pneumatic cylinder device 108 is then operated to retract its operating rod longitudinally back out of the channel 102 pulling the coiled shoelace out of the confining sleeve 36 through its exit slot 60 and into the channel 102 through its open entrance end 98. The operating rod of the seventh pneumatic cylinder device 108 continues to retract pulling the shoelace coil through the channel 102, compressing the shoelace coil into an oblong configuration, until it pulls the shoelace coil to a preselected position in the channel 102 in alignment with the label delivery station 24. The eighth pneumatic cylinder device 112 is then operated to retract its operating rod causing the hook 110 to pivot away from the flattened shoelace coil in the channel 102 at the preselected position to disengage from the shoelace coil as the operating rod of the seventh pneumatic cylinder device 108 continues to retract completely out of the channel 102. Sensor means 113, such as a proximity switch, at the seventh pneumatic cylinder 108 is operatively associated with the central control unit 46 to signal the central control unit 46 when the seventh cylindrical device 108 is retracted completely out of the channel 102. The eighth pneumatic cylinder device 112 can be activated in timed response to the operation of the operation of the seventh pneumatic cylinder device 108 by means of, for example, sensor means 114, such as a proximity switch 114 at the seventh pneumatic cylinder device 108 operatively associated with the central control unit 46 which signals the central control unit 46 when seventh pneumatic cylinder unit 108 has retracted its operating rod positioning the hook 110 at the preselected position in the channel 102.

Summarizing the operation of the apparatus 5 to this point, when the counter of the central control unit 46 has counted the signals from the revolution determining means 82 corresponding to the predetermined revolutions of the winding mandrel 34, the central control unit 46 causes the solenoid-operated first air-operated device 57 to activate disengaging the clutch means 55 so that the shifting shaft 50, and, therefore, the mandrel 34, stop rotating. When the first air-operated device activates the sensor means 61, the sensor means 61 signals the central control unit 46 that the winding mandrel 34 has stopped rotating. The central control unit 46 then causes the solenoid-operated fifth air-operated device 90 to activate the shifting means 84 to pull the shifting shaft 50 axially out of the drive tube 42, thereby pulling the mandrel 34 out of the confining sleeve 36. At this point in time, operating rod of the seventh air-operated cylinder device 108 is extended positioning the hook 110 at the winding station 18. Simultaneously with the central control unit 46 activating the shifting means 84, the central control unit 46 causes the solenoid-operated eighth air-operated device 112 to activate moving the hook 110 toward the shoelace coil in the confining sleeve at the winding station 18 to engage the shoelace coil.

The central control unit 46 next causes the solenoid-operated seventh air-operated cylinder device 108 to retract the hook 110 from the winding station 18 back through the channel 102 of the channel member 96 to the preselected position in the channel 102 whereat the central control unit 46 causes the solenoid-operated eighth air-operated device 112 to activate moving the hook 110 away from the shoelace at the preselected position in the channel 102 to disengage the shoelace coil. The operating rod of the seventh air-operated cylinder device 108 continues to retract until the hook 110 is completely removed from the channel 102.

After the operating rod of the seventh pneumatic cylinder device 108 has retracted completely out of the open opposite end 100 of the channel member 96, the central control unit 46 causes the solenoid-operated sixth pneumatic cylinder device 104 to operate to extend its operating rod to move the channel member 96 from its lowered position to its raised position.

With reference to FIGS. 2 and 5, the label delivery station 24 indexes to position labels 16 one at a time across the open longitudinal front side of the raised channel member 98 at the preselected location of, and in alignment with, a flattened shoelace coil in the channel 102 whereat the hook 110 disengaged from the flattened shoelace coil. The label delivery station 24 is shown as including a supply rool 118 of labels 16 mounted for rotation over the channel member 96. The supply rool 118 is indexed to deliver labels 16 one at a time across the channel members 96 by an actuator 120, such as for example a step motor, drivingly connected to the label supply rool 118 by, for example, a drive chain and operatively associated with the central control unit 46. The actuator 120 is operated in response to the positioning of a shoelace coil at the preselected position in the channel member 96. Sensor means 122, such as a proximity switch 122, at the seventh pneumatic cylinder device 108 is operatively associated with the central control unit 46 to signal the central control unit 46 when the hook 110 has been removed from the channel 102 of the channel member 96. When the seventh pneumatic cylinder device 108 has moved the hook 112 from the channel 102, the central control unit 46 activates the roll actuator 120 indexing a label.

With continued reference to FIGS. 2 and 5, shoelace coil ejector means 124 is located at the back longitudinal side of the channel member 96 in alignment with the preselected position of the flattened shoelace coil in the channel 102. The ejector means 124 includes a solenoid-operated ninth air-operated device 126 operatively associated with the central control unit 46, such as a pneumatic cylinder device, mounted on the channel member 96 with its operating rod perpendicular to the longitudinal axis of the channel 102 of the channel member 96. A shoelace coil contacting plate 128 is affixed to the distal end of the operating rod of the ninth pneumatic cylinder device 126 and a label cutting blade 130 is also affixed to the distal end of the operating rod of the ninth pneumatic cylinder device 126 for movement with the operating rod. The ninth pneumatic cylinder device 126 is operated by the central control unit 46 to extend its operating rod perpendicularly to the longitudinal axis of the channel 102 to move the shoelace coil contacting plate 128 and label cutting blade 130 into the channel 102 of the channel member 96, and to retract its operating rod to move the contacting plate 128 and label cutting blade 130 out of the channel 102 through a appropriate clearance aperture in the back longitudinal side of the channel member 96. The ninth pneumatic cylinder device 126 is operated by the central control unit 46 to extend its operating rod in timed relationship to the operation of the label delivery station 24 by the central control unit 46 to sever a label 16 disposed across the open longitudinal front side of the channel member 96 from the supply roll, and to push the flattened shoelace coil at the preselected position across the severed label 16 and out of the channel 102. Sensor means 131, such as a proximity switch, at the ninth pneumatic cylinder device 126 is operatively associated with the central control unit 46 to signal the central control unit 46 of the position of the contacting plate 96.

With continued reference to FIGS. 2 and 5, the label wrapping station 26 is shown as including an elongated shoelace package receiving tray 132 having an open inlet end 134. The elongated shoelace package receiving tray 132 is horizontally disposed and perpendicular to the longitudinal axis of the channel member 96 at the elevation of the raised channel member 96 such that the open inlet end 134 of the tray 132 is in aligned relationship with the open longitudinal front side of the channel member 96 when it is in its raised position at the preselected position of the elongated shoelace coil in the channel 102 to be packaged and in alignment with the label 16 extending across the open longitudinal front side of the channel member 96. The elongated tray 132 is mounted over the frame structure 10 for selective movement along its longitudinal axis perpendicular to the longitudinal axis of the channel 102 toward and away from open longitudinal front side of the channel member 96 in timed relationship to the operation of the flattening station 22 and label delivery station 24. The elongated tray 132 is movable toward and away from the channel member 96 by means of a solenoid-operated tenth operated actuator device 136 operatively associated with the central control unit 46, such as a pneumatic cylinder device, with its operating rod perpendicular to the longitudinal axis of the channel member 96. The tray 132 is attached to the operating rod of the tenth pneumatic cylinder device 136 for movement therewith toward the channel member 96 as the tenth pneumatic cylinder device is operated by the central control unit 46 to extend its operating rod, and for movement away from the channel member 96 as it is operated by the central control unit 46 to retract its operating rod. Sensor means 137, such as a proximity switch, at the tenth pneumatic cylinder device is operatively associated with the central control unit 46 to signal the central control unit of the position of the tray 132. In addition, a first label folding blade 138 is mounted to the top side of the tray 132 at the open inlet end 134 for movement perpendicularly downwardly to the longitudinal axis of the tray 132 across the open inlet end 134 of the tray, and a second label folding blade 140 is mounted to the bottom side of the tray 132 at the open inlet end 134 for movement perpendicularly upwardly to the longitudinal axis of the tray 132 across the open inlet end 134 of the tray. Toward this objective, a solenois-operated eleventh air-operated device 142, such as a pneumatic cylinder device, is mounted to the top side of the tray 132 with its operating rod extending perpendicular to the longitudinal axis of the elongated tray 132 at the open inlet end 134 and the first label folding blade 138 is attached to the distal end of the operating rod, and a solenoid-operated twelfth air-operated device 144 operatively associated with the central control unit 46, such as a pneumatic cylinder device, is mounted to the bottom side of the tray 132 with its operating rod extending perpendicular to the longitudinal axis of the elongated tray 132 at the open inlet end 134 and the second label folding blade 140 is attached to the distal end of the operating rod. Sensor means 145, such as a proximity switch, at the eleventh pneumatic cylinder device 142 is operatively associated with the central control unit 46 to signal the central control unit 46 of the position of the first folding blade 138. Sensor means 147, such as a proximity switch, at the twelfth pneumatic cylinder device 144 is operatively associated with the central control unit 46 to signal the central control unit 46 of the position of the second folding blade 140. The tenth pneumatic cylinder device 136 is operated in timed relationship with the flattening station 22 and label delivery station 24 to move the tray toward the channel member 96 after the label delivery station 24 has actuated to move a label 16 across the open longitudinal front side of the channel 96 and before the shoelace coil ejector means 124 has been actuated to eject the elongated shoelace coil from the channel 102 of the channel member 96. When the tray 132 has been moved to the channel member 96, the ninth pneumatic cylinder device 126 of the ejector means 124 is operated by the central control unit 46 to extend its operating cylinder moving the label cutting blade 130 through the channel 102 to sever the label 16 disposed across the open longitudinal front side of the channel member 96 and moving the shoelace coil contacting plate 128 into the channel 102 into contact with the elongated shoelace coil at the preselected position to push the severed label 16 and elongated shoelace coil through the open inlet end 134 of the tray 132. The ninth pneumatic cylinder device 126 is then operated by the central control unit 46 to retract its operating rod. As the severed label and ejected elongated shoelace coil pass through the open inlet 134 of the tray 132, the top and bottom edges of the label 16 extending beyond the top and bottom sides of the elongated shoelace coil are folded over the top and bottom sides, respectively, of the shoelace coil as they contact the top and bottom sides of the tray 132. Therefore, when the shoelace coil is in the tray 132, the top and bottom edges of the label 16 extend outwardly of the open inlet end 134 of the tray 132. The tenth pneumatic cylinder device 136 is then actuated by the central control unit 46 to retract its operating rod to move the tray 132 back away from the channel member 96. Next, the eleventh pneumatic cylinder device 142 is actuated by the central control unit 46 to extend its operating rod to move the first label folding blade 138 downwardly across the tray open inlet end 134 folding the top outwardly extending edge of the label 16 downwardly across the shoelace coil at the tray open inlet end 134. As the eleventh pneumatic cylinder device 142 is actuated by the central control unit 46 to retract its operating rod, the twelfth pneumatic cylinder device 144 is actuated by the central control unit 46 to extend its operating rod to move the second label folding blade 140 upwardly across the tray inlet end 134 folding the bottom outwardly extending edge of the label 16 upwardly across the shoelace coil at the tray open inlet end 134 overlapping the folded top edge of the label. In the event the label includes a heat actuated adhesive to fasten the folded over top and bottom edges of the label together over the shoelace coil, second folding blade 140 can be heated to activate the adhesive.

The operation of the various air-operated actuator devices 57, 68, 72, 78, 90, 104, 108, 112, 126, 136, 142 and 144 are all controlled to operate in properly timed relationship to each other by the central control means, such as a computer or processor, generally denoted as the numeral 46. The central control means 146 can be programmed to operate the solenoid operated valves in appropriately timed relationship thereby controlling the entire operation of the apparatus 5. This feature is particularly advantageous when the apparatus 5 is used to package shoelaces of a different length, which requires a retiming of the operation of the various components. In this event, all that must be done is a reprogramming of the central control means 146. This reprogramming can be done quickly by having a number of pre-existing programs for winding different length shoelaces which can replace each other in the central control unit 46.

The foregoing detailed description is given primarily for clearness of understanding and no limitations are to be understood therefrom for modifications will become obvious to those skilled in the art upon reading this disclosure and may be made without departing from the scope of the invention and scope of the appended claims.

I claim:

1. An apparatus for winding and packaging shoelaces into flattened coiled packages comprising:

a winding station for winding a pair of shoelaces into a circular coil configuration comprising a cylindrical mandrel about which the shoelace pairs are wound into a shoelace pair coil, the cylindrical mandrel being mounted for rotation about its longitudinal axis and for movement in both directions along its longitudinal axis, a cylindrical shoelace coil confining sleeve concentrically receiving the cylindrical mandrel, the confining sleeve being mounted in a fixed position against rotation and against movement along its longitudinal axis, and a doffing sleeve concentrically received within the cylindrical mandrel, the doffing sleeve being mounted for rotation about its longitudinal axis and against movement along its longitudinal axis, a drive tube operatively associated with the doffing sleeve for rotating the doffing sleeve, the drive tube being mounted for rotation about its longitudinal axis, a mandrel shifting shaft operatively associated with the mandrel for rotating the mandrel and for moving the mandrel along its longitudinal axis, the shifting shaft being concentrically disposed within the doffing sleeve drive tube for longitudinal movement within the drive tube and for rotation with the doffing sleeve about the coaxis of the drive tube and mandrel shifting shaft, means for rotating the doffing sleeve drive tube, transmission means in driven operative association with the doffing sleeve drive tube and in selective driving operative association with the mandrel shifting shaft;

a coiled shoelace pair flattening station next to the winding station for receiving wound shoelace pairs from the winding station and flattening the shoelace pair circular coil into an oblong coil;

a label delivery station at the flattening station for positioning a label across a flattened shoelace pair coil in the flattening station;

a wrapping station located next to the flattening station in alignment with the label delivery station for receiving the flattened shoelace pair coil from the flattening station and a label disposed across the flattening station and wrapping the label circumferentially around the flattening shoelace coil pair to form the flattened coil package;

programmable central control means for controlling the operation of the winding station, coiled shoelace pair flattening station, label delivery station, and wrapper station in timed relationship, the programmable central control means including programmable counting means in which is stored a predetermined number of revolutions of the winding cylindrical mandrel corresponding to the length of the shoelace to be wound into a coil;

winding station revolution determining means for determining the number of revolutions made by the cylindrical mandrel as it wins a shoelace pair into a coil, the revolution determining means being operatively associated with the mandrel shifting shaft and being operatively associated with the central control means; and, the transmission means being operatively associated with the central control means to disengage the transmission when the predetermined number of revolutions of the cylindrical mandrel has been counted by the counting means of the central control means.

2. The apparatus of claim 1, wherein the shoelace winding station comprises:

means defining a shoelace entrance slot in the cylindrical shoelace coil confining sleeve;

a shoelace tensioning device located at the exterior of the confining sleeve adjacent the shoelace entrance slot for movement toward the entrance slot for exerting a tension on and guiding a shoelace pair extending through the entrance slot, and movement away from the entrance slot to clear the entrance slot for the insertion in the entrance slot of the next shoelace pair to be wound on the mandrel, the shoelace tensioning means being operatively associated with the central control means.

3. The apparatus of claim 1, further comprising:

a conveyor for delivering pairs of shoelaces to be wound to the winding station; and, a shoelace gripping and transfer device for transferring shoelace pairs to be wound from the conveyor device to the winding station, the shoelace gripping and transfer device being operatively associated with the central control means.

4. The apparatus of claim 1, wherein the winding station revolution determining means comprises: a plurality of radial projections spaced apart from each other circumferentially of the shifting shaft and attached to the mandrel shifting shaft for rotation therewith and movement therewith in the longitudinal direction of the drive tube;

a sensor means located adjacent the imaginary circle circumscribed by the distal ends of the radial projections for sensing movement therepast of each projection; and, the sensor means being operatively associated with the central control means.

5. The apparatus of claim 4, further comprising shifting means for moving the mandrel shifting shaft to move the mandrel into and out of the confining sleeve operatively associated with the central control means.

6. The apparatus of claim 1, wherein the coiled shoelace pair flattening station comprises:

an elongated shoelace receiving channel member having an open shoelace coil entrance end and an open opposite end, the channel member being mounted horizontally for movement in a vertical direction transverse to its longitudinal axis between a lowered position whereat the open entrance end is adjacent to and in alignment with the shoelace winding station to receive a coiled shoelace pair therefrom and a raised position parallel to and spaced above the lowered position; and, a device for raising and lowering the shoelace receiving channel operatively associated with the central control means.

7. The apparatus of claim 6, wherein the shoelace pair flattening station further comprises a device for removing the coiled shoelace pair from the winding station and moving the coiled shoelace pair into the channel member when the channel member is in the lowered position to flatten the shoelace coil to a preselected position in the channel member in alignment with the label delivery station, the coiled shoelace pair removing device being operatively associated with the central control means.

8. The apparatus of claim 7, wherein the coiled shoelace pair removing device further comprises shoelace coil engaging means for engaging the shoelace coil at the winding station and disengaging the flattened shoelace coil in the channel member after the coiled shoelace pair removing device has moved the flattened shoelace coil to the preselected position, the engaging means being operatively associated with the central control means.

9. The apparatus of claim 7, wherein the label delivery station comprises means for delivering a label transversely across the channel member at the preselected position of a flattened coil shoelace pair in the channel member when the channel member is in the raised position, the label delivery station being operatively associated with the central control means.

10. The apparatus of claim 9, wherein the flattening station further comprises shoelace coil ejector means located at the channel member at the preselected position of a flattened shoelace pair in the channel member and in alignment with the wrapping station for pushing the flattened shoelace coil in the channel member across the label and out of the channel member into the wrapping station when the channel member is in the raised position, the coil ejector means being operatively associated with the central control means.

11. The apparatus of claim 6, wherein the wrapping station comprises a flattened shoelace receiving tray having an open flattened shoelace coil receiving end at the elevation of the raised position of the channel member for receiving a flattened shoelace coil and label therefrom when the channel member is in its raised position to thereby at least partially wrap the label about the flattened shoelace coil, the flattened shoelace receiving tray being mounted for movement toward and away from the channel member in timed relationship to the operation of the flattening station and label delivery station, the shoelace receiving tray being cooperatively associated with the central control means.

12. The apparatus of claim 11, wherein the wrapping station further comprises:

a first label folding blade mounted to the receiving tray at the open end of the receiving tray for movement across the open end from one side of the receiving tray;

a second label folding blade mounted to the receiving tray at the open end of the receiving tray for movement across the open end from the other side of the receiving tray; and the first and second label folding blades being operatively associated with the central control means.

* * * * *